US006308909B1

(12) United States Patent
McNeil et al.

(10) Patent No.: US 6,308,909 B1
(45) Date of Patent: Oct. 30, 2001

(54) WEB REWINDER CHOP-OFF AND TRANSFER ASSEMBLY

(75) Inventors: Kevin Benson McNeil, Loveland; Jeffrey Moss Vaughn, Cincinnati, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/246,384

(22) Filed: Feb. 9, 1999

(51) Int. Cl.[7] ..... B65H 35/04; B65H 35/00; B65H 67/00

(52) U.S. Cl. ..... 242/527.4; 242/521; 242/533.4; 242/527.2

(58) Field of Search ..... 242/521, 533.4, 242/527, 527.4, 527.2

(56) References Cited

U.S. PATENT DOCUMENTS

| | | | | |
|---|---|---|---|---|
| 2,266,995 | * | 12/1941 | Schultz et al. | 242/533.4 X |
| 2,769,600 | | 11/1956 | Kwitek et al. . | |
| 3,148,843 | * | 9/1964 | Turner et al. . | |
| 3,179,348 | | 4/1965 | Nystrand et al. . | |
| 3,549,097 | | 12/1970 | Seigh . | |
| 3,552,670 | | 1/1971 | Herman . | |
| 3,697,010 | | 10/1972 | Nystrand . | |
| 3,791,602 | * | 2/1974 | Isakson | 242/521 |
| 3,794,255 | | 2/1974 | Harmon . | |
| 4,487,377 | * | 12/1984 | Perini | 242/521 |
| 4,541,583 | * | 9/1985 | Forman et al. | 242/527.3 |
| 4,687,153 | * | 8/1987 | McNeil | 242/521 |
| 4,775,110 | * | 10/1988 | Welp et al. | 242/521 |
| 4,919,351 | | 4/1990 | McNeil . | |
| 5,137,225 | * | 8/1992 | Biagiotti | 242/521 |
| 5,542,622 | * | 8/1996 | Biagiotti | 242/521 |
| 5,660,349 | * | 8/1997 | Miller et al. | 242/526.1 |
| 5,660,350 | | 8/1997 | McNeil et al. | 242/533.4 |
| 5,667,162 | | 9/1997 | McNeil et al. | 242/533.4 |
| 5,690,296 | * | 11/1997 | Biagiotti | 242/521 |
| 5,690,297 | | 11/1997 | McNeil et al. | 242/533.4 |
| 5,725,176 | * | 3/1998 | Vigneau | 242/521 |
| 5,732,901 | | 3/1998 | McNeil et al. | 242/533.4 |
| 5,810,282 | | 9/1998 | McNeil et al. | 242/533.4 |
| 5,845,867 | * | 12/1998 | Hould et al. | 242/527 |
| 5,853,140 | | 12/1998 | Biagiotti | 242/534 |
| 5,979,818 | * | 11/1999 | Perini et al. | 242/521 |
| 6,056,229 | * | 5/2000 | Blume et al. | 242/521 |

FOREIGN PATENT DOCUMENTS

| | | |
|---|---|---|
| 28 25 154 A | 12/1979 | (DE) . |
| 0 237 903 A | 9/1987 | (EP) . |
| 0 607 525 A | 7/1994 | (EP) . |

* cited by examiner

*Primary Examiner*—Donald P. Walsh
*Assistant Examiner*—Minh-Chau Pham
(74) *Attorney, Agent, or Firm*—Jays A. Krebs; Vladimir Vitenberg; David M. Weirich

(57) ABSTRACT

A web transfer and chop-off assembly for a paper web rewinder used in a paper converting operation capable of maintaining positive control of the web at all times. The web transfer and chop-off assembly delivers a web to an empty core faced with glue and supported on a mandrel of a web winding turret assembly, at about the same time the web is severed from a fully wound core supported on a second mandrel on the turret assembly.

8 Claims, 11 Drawing Sheets

WEB REWINDER CHOP-OFF AND TRANSFER ASSEMBLY

FIELD OF THE INVENTION

The present invention relates to a web rewinder for unwinding parent rolls of web material such as, for example, paper, and rewinding the web onto cores to produce consumer rolls of web product such as rolls of paper towels, or rolls of toilet tissue. More specifically, the present invention relates to a web chop-off and transfer mechanism providing improved reliability for such web rewinder.

BACKGROUND OF THE INVENTION

Rewinders are apparatus for unwinding parent rolls of web material such as paper and rewinding the web into consumer product rolls. Such product rolls include paper towels and toilet tissue each of which typically comprise multiple tear-apart sheets. Rewinders may include a perforating cylinder for making traverse lines of perforations in the web at sheet length intervals providing lines of weakening for tear apart convenience. The rewinders often include a rotating turret assembly supporting a plurality of mandrels which in turn support the cores on which the product is wound in order to produce consumer product rolls. The rotating turret assembly provides a mechanical means for core loading, core gluing, web rewinding, and log stripping. The transfer of the web from a fully wound core to an empty core is performed by a web transfer and web chop-off mechanism.

For conventional turret winders, the web chop-off occurs at a position between adjacent mandrels. The turret winder may be equipped with a plurality, typically six or more mandrels, each of which goes through the same orbital path. This permits the mandrel to be equipped with a paperboard core on which the tissue or toweling is wound, the core faced with glue, the actual winding, and ultimately the removal of the wound roll from the mandrel. Near the end of the rewinding on a given mandrel core, the subsequent mandrel is in a position close to the fast traveling web so as to pick it up and continue the rewinding operation when the web has been severed. It has been the conventional practice to sever the web between the mandrel which has just finished its rewinding operation and the mandrel which is just to start its rewinding operation.

For conventional turret winders rotation of the turret assembly is indexed in a stop and start manner to provide for core loading and log unloading while the mandrels are stationary. Such indexing turret winders are disclosed in the following U.S. Patents: U.S. Pat. No. 2,769,600 issued Nov. 6, 1956 to Kwitek et al; U.S. Pat. No. 3,179,348 issued Sep. 17, 1962 to Nystrand et al.; U.S. Pat. No. 3,552,670 issued Jun. 12, 1968 to Herman; and U.S. Pat. No. 4,687,153 issued Aug. 18, 1987 to McNeil. The McNeil Patent is incorporated herein by reference. Indexing turret assemblies are commercially available on Series 150, 200, and 250 rewinders manufactured by the Paper Converting Machine Company of Green Bay, Wis.

The indexing of the turret assembly is undesirable because of the resulting inertia forces and vibration caused by accelerating and decelerating a rotating turret assembly. Consequently, the indexing turret assembly has been supplanted by a continuously rotating turret assembly as described in U.S. Pat. No. 5,690,297 issued Nov. 25, 1997 to McNeil et al., U.S. Pat. No. 5,667,162 issued Sep. 16, 1997 to McNeil et al., U.S. Pat. No. 5,732,901 issued Mar. 31, 1998 to McNeil et al., U.S. Pat. No. 5,660,350 issued Apr. 26, 1997 to McNeil et al., and U.S. Pat. No. 5,810,282 issued Sep. 22, 1998 to McNeil et al. all of which are incorporated herein by reference. The continuous motion turret assembly provides a means for uninterrupted core loading, core gluing, web rewinding, and log stripping.

Although the continuous rotation turret assembly has resulted in a faster rewinder operating rate, the area which is still not optimized is the web chop-off and transfer procedure. Web chop-off generally requires severing the web at a discrete line of perforation on the web in order to achieve the necessary roll sheet count. To achieve transfer of the web from the one mandrel to another, it is necessary to synchronize the chop-off with transfer of the web to the new mandrel that is about to commence the web winding operation. If the two are not performed simultaneously, control of the web is momentarily lost upon severing the web, leaving an unsupported free end to be urged against an empty core resulting in a wrinkled, uneven web transfer to the empty core and consequently, a poor quality product.

A web chop-off and transfer mechanism typically comprises a chopper roll in combination with a bedroll. The chopper roll and bedroll combination comprises a set of chop-off blades for separating the paper web by breaking the web along one of the lines of perforations. A rewinder of that type where one of the chop-off blades is disposed on the chop-off roll per se, and two on the bedroll, is disclosed in U.S. Pat. No. 4,687,153 which issued Aug. 18, 1987 to McNeil which patent is incorporated herein by reference for the purpose of generally disclosing the operation of the bedroll and chopper roll in providing web transfer.

In that rewinder, the bedroll is a hollow steel cylinder containing components that assist in chop-off and transfer of the web. These include cam actuated blades and transfer pins as well as transfer pads which operate independently from the blades and pins. The two bedroll blades comprise a leading bedroll blade and a trailing blade. The transfer pins are sharpened to a point enabling them to pierce and carry the chopped off web. Approaching chop-off, the bedroll blades are actuated by unlatching a spring loaded mechanism and subsequent contact with a cam in order to lift the web from the surface of the bedroll. Once the blades are fully extended, the web is constrained by contact with a sharp serrated edge of the leading bedroll blade. The blade on the chopper roll enters between the bedroll blades, meshing therebetween. As the meshing occurs, the length of the running web of paper which extends between the tips of the bedroll's chop-off blades is stretched into a deepening V-shape. The meshing must be adequate to ensure sufficient stretching to induce either tearing or breaking of the web. For more pliable paper running at low web tensions, the meshing operation cannot achieve the desired chop-off resulting in product rolls with incorrect sheet counts or equipment downtime due to a tangled web. Coincident with the blade meshing, the sharp pins which trail the bedroll chop-off blades penetrate the leading edge of the sheet trailing the web break point. During pin penetration the sheet is held against a foam pad mounted to the chopper roll.

In effort to provide a larger chop-off window, an improved web transfer and chop-off assembly was devised providing a means for continuously maintaining the chop-off blades in parallel relationship during roll ending events. Such an assembly is described in U.S. Pat. No. 4,919,351 Issued Apr. 24, 1990 to McNeil and is incorporated herein by reference. The improved transfer and chop-off assembly comprises two side-by-side blades on the chop-off roll and three side-by-side blades along with the transfer pins on the bedroll. The five blades mesh together in a motion parallel to the line between the centers of the bedroll and the chopper roll, allowing deeper blade mesh and a greater stretch while utilizing a wider chop-off window.

For each of the web transfer and chop-off assemblies described, once the web is broken at the perforation, the bedroll pins support the cut end prior to being transferred to the next empty core. During this time, the edge of the cut end is blown in a direction opposite the web transfer, creating a reverse fold. This folded free edge is then transferred to the empty core resulting in a wrinkled, uneven web delivery to the empty core which can effect several revolutions of winding on the core producing a poor quality product and at times, resulting in equipment malfunction.

The present invention provides a web transfer and chop-off assembly in which web transfer to an empty core on the turret assembly is initiated about the same time web chop-off from a roll having completed the web winding cycle occurs. Consequently, control of the web is maintained throughout the web rewinding cycle as the web is transferred from core to core resulting in improved product quality and rewinder reliability.

Performance enhancing fluids are often added to paper webs to improve the properties of the web. For conventional set-ups, the fluid application occurs upstream of the perforator roll generally due to lack of space within the rewinder setup as well as the consequential equipment downtime that would be required to rid the bedroll of the fluids. As a result, the perforator roll becomes coated affecting perforator performance and resulting in significant equipment downtime to clean the perforator roll.

The present invention provides a web transfer and chop-off assembly having improved maintainability while occupying minimal space in the web rewinding set-up by eliminating the need for a bedroll. Such web transfer and chop-off assembly facilitates the installation of a fluid application means within the web rewinder between the perforator roll and the web transfer and chop-off assembly.

SUMMARY OF THE INVENTION

A web transfer and chop-off assembly for a web rewinder capable of delivering a web advancing along a path to an empty core faced with glue and supported on a first mandrel of a web winding turret assembly at about the same time the web is severed from a fully wound core supported on a second mandrel in sequence on the turret assembly. The web transfer and chop-off assembly comprises a web transfer assembly juxtaposed to the web path for pressing the web against the empty core and forming a transfer nip therewith during web transfer. A means for accelerating the web is disposed downstream of the transfer nip for producing sufficient tension to break the web from a fully wound core once the delivery of the web to the empty core has been initiated.

In several embodiments of the present invention, the web transfer and chop-off assembly includes a bedroll juxtaposed to the web path. For these embodiments, the web transfer assembly comprises a transfer pad mounted on the periphery of the bedroll. During the rotation of the bedroll, a leading edge of the transfer pad forms a transfer nip with the empty core. The length of the transfer pad is sized to maintain the transfer nip for one full revolution of the empty core and to clear the core during the web winding cycle.

In other embodiments of the present invention, the bedroll has been eliminated and the web transfer assembly comprises a transfer roll having a surface speed that equals the web speed. The transfer roll is rotatably attached to a transfer roll pivot arm. The transfer roll pivot arm rotates the transfer roll about a pivot end from a first position forming a transfer nip with the empty core to a second position withdrawn away from the web, allowing the core to pass and complete the winding cycle.

The web acceleration means of the present invention can comprise two chop-off rolls positioned on opposite sides of the web path downstream of the transfer nip. Each chop-off roll has a surface speed that exceeds the web speed. As the transfer roll forms the transfer nip with the empty core, the two chop-off rolls advance towards one another forming a chop-off nip with the web disposed therebetween. As the web is held at the transfer nip, the chop-off nip accelerates the web creating a tension sufficient to break the web. The two chop-off rolls withdraw from the web allowing the core to pass and complete the winding cycle.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Definitions

As used herein, the following terms have the following meanings:

"Machine direction", designated MD, is the direction parallel to the flow of paper through the paper converting equipment.

"Cross machine direction", designated CD, is the direction perpendicular to the machine direction.

A "nip" is a loading plane connecting the centers of two parallel axes.

A "core winding cycle" is the time required to complete the rewinding of a desired length of paper onto a single core to produce a consumer product roll of paper.

A "log" is a roll of paper wound on a core that has completed the core winding cycle.

Figure 1:
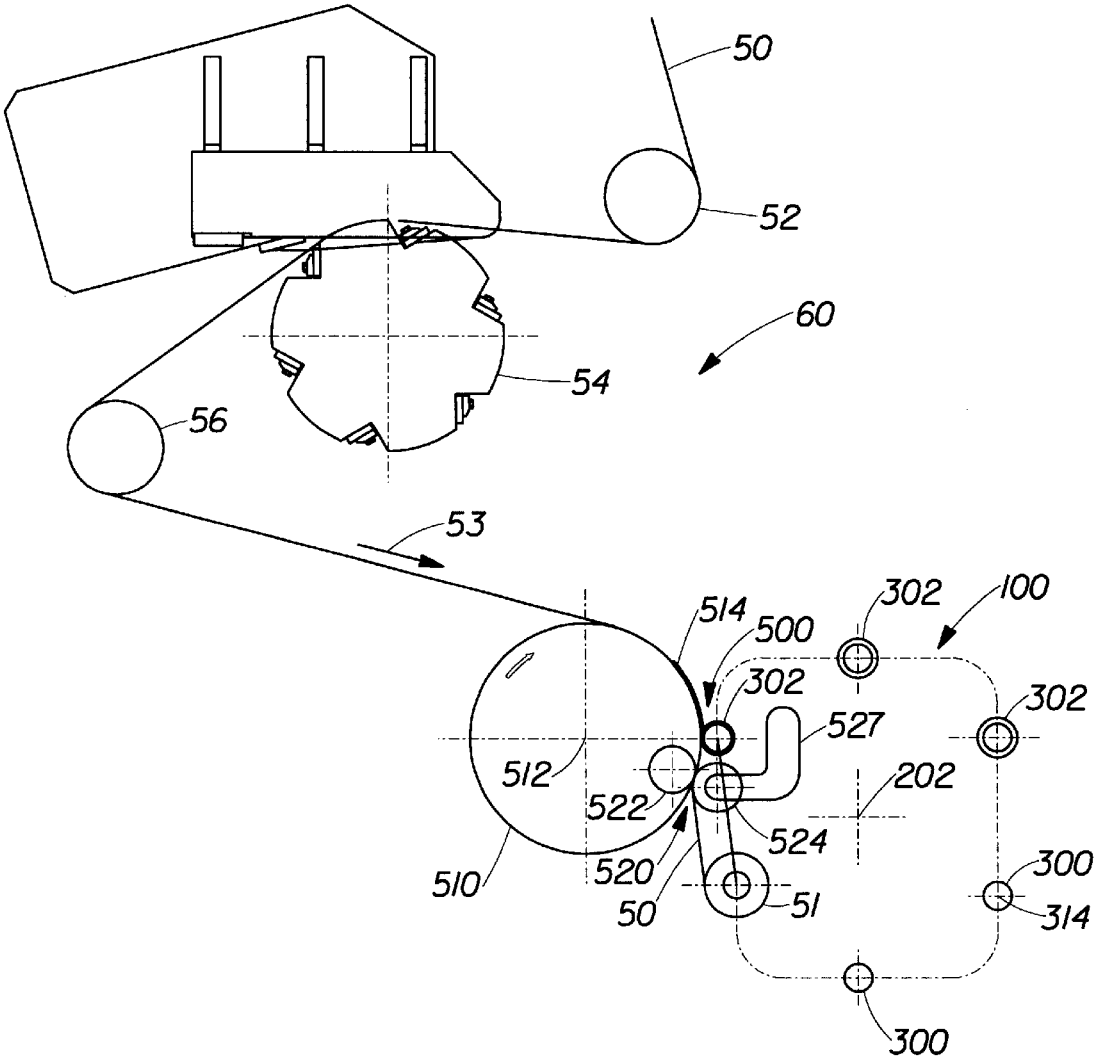
FIG. 1 is a side view of a web rewinder assembly illustrating the web path, turret winder assembly, and the web transfer and web chop-off assembly.

Illustrated in FIG. 1 is a web rewinding assembly 60 for rewinding a paper web 50 from a parent roll (not shown) to individual cores 302 supported on mandrels 300 of a rotating turret winder assembly 100. During the web rewinding process, the web 50 travels along a path 53 in the machine direction and enters a perforator roll 54 which produces lines of perforations running in the cross machine direction on the web 50. The web 50 may travel across a web slitter roll 56 before entering the web transfer and web chop off assembly 500. For the present invention, the web transfer and chop-off assembly 500 provides the delivery of the web 50 to an empty core 302 generally at about the same time the web 50 is severed from a log 51 having completed the web winding cycle. (For the present invention, "at about the same time" includes a period of time ranging from concurrently to the time required for the empty core 302 to complete one revolution or less of web transfer). Although the present invention is equally applicable to all types of rewinders, the web transfer and chop-off assemblies 500 described herein are applicable to web rewinder assemblies including continuous motion turret systems used in producing consumer rolls of paper products such as paper towels and toilet tissue as well as Geneva wheel rewinders.

Figure 2:
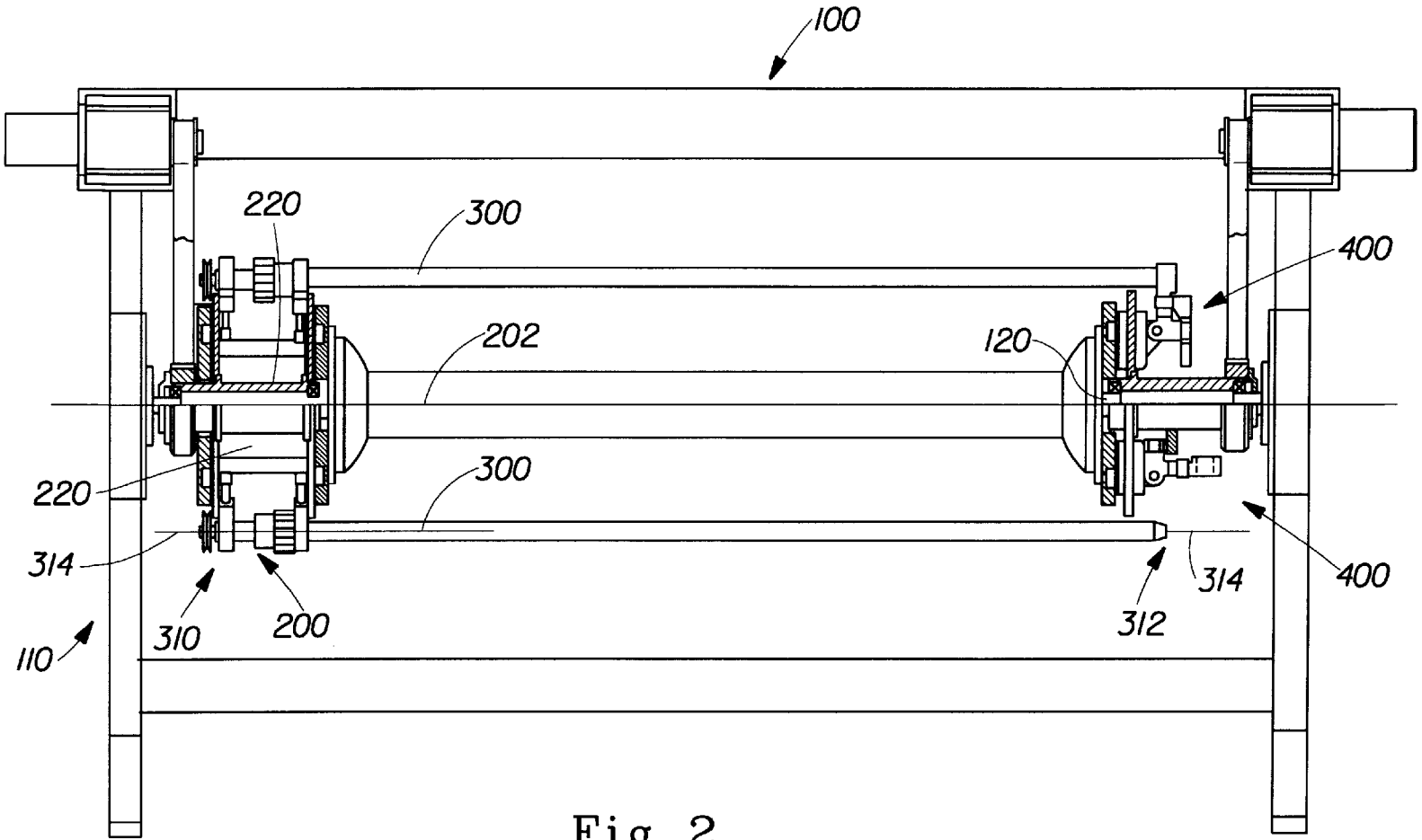
FIG. 2 is a partially cut away front view of a turret winder.
Figure 3:
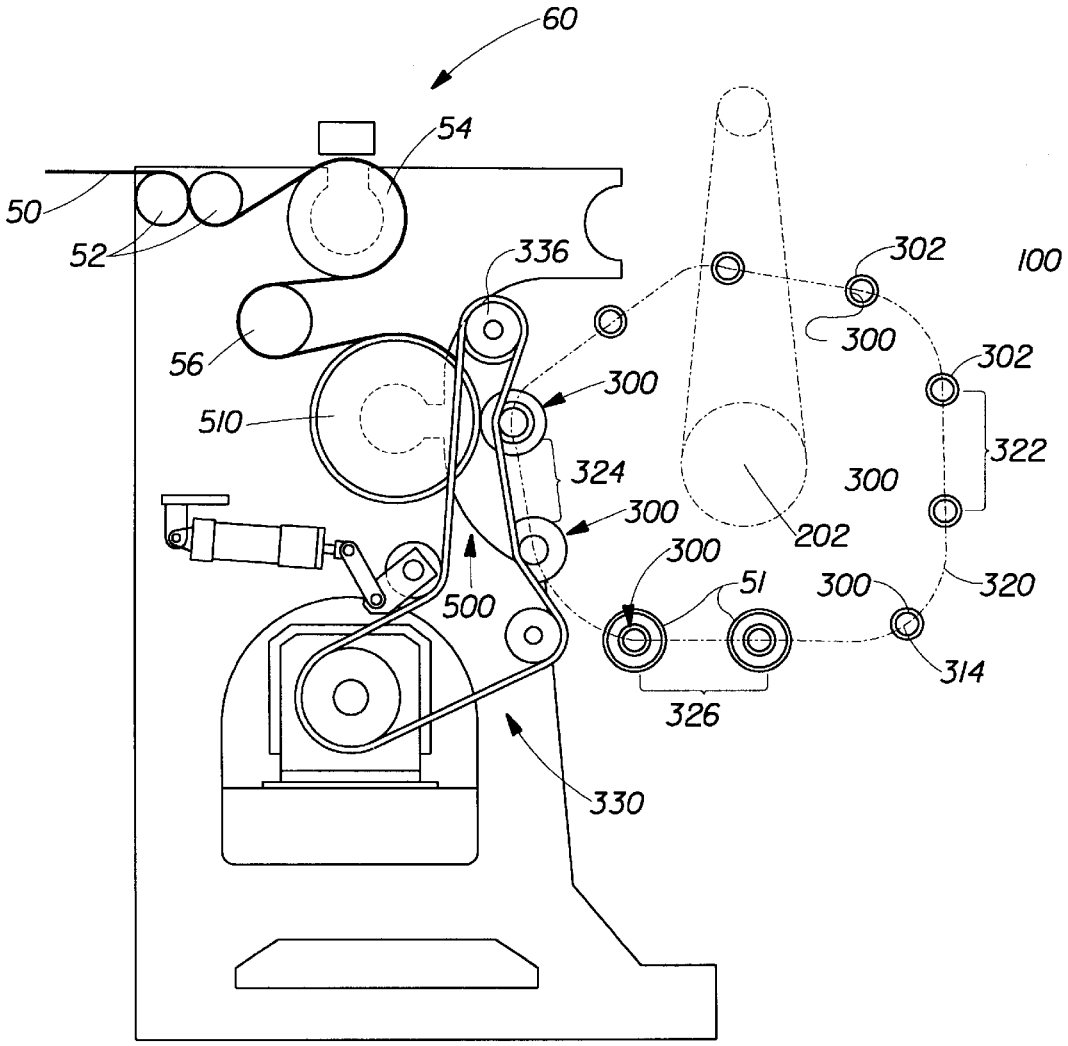
FIG. 3 a side view showing the position of the closed mandrel path and mandrel drive system of the turret winder relative to an upstream conventional rewinder assembly.

Referring to FIGS. 2 and 3, a turret winder 100 supports a plurality of mandrels 300. The mandrels 300 engage cores 302 upon which a paper web is wound. The mandrels 300 are driven in a closed mandrel path 320 about a turret assembly central axis 202. Each mandrel 300 extends along a mandrel axis 314 generally parallel to the turret assembly central axis 202, from a first mandrel end 3 0 to a second mandrel end 312. The mandrels 300 are supported at their first ends 310 by a rotatably driven turret assembly 200. The mandrels 300 are releasably supported at their second ends 312 by a mandrel cupping assembly 400. The turret winder 100 preferably supports at least three mandrels 300, more preferably at least 6 mandrels 300, and in one embodiment the turret winder 100 supports ten mandrels 300. A turret winder 100 supporting at least 10 mandrels 300 can have a rotatably driven turret assembly 200 which is rotated at a relatively low angular velocity to reduce vibration and inertia loads, while providing increased throughput relative to a indexing turret winder which is intermittently rotated at higher angular velocities.

As shown in FIG. 3, the closed mandrel path 320 can be non-circular, and can include a core loading segment 322, a web winding segment 324, and a core stripping segment 326.

Once core loading is complete on a particular mandrel 300, the core 302 is carried to the web winding segment 324 of the closed mandrel path 320. Intermediate the core loading segment 322 and the web winding segment 324, a web securing adhesive can be applied to the core 302 by an adhesive application apparatus as the core and its associated mandrel are carried along the closed mandrel path 320.

During movement of the mandrel and core along the web winding segment 324, a mandrel drive apparatus 330 provides rotation of each mandrel 300 and its associated core 302 about the mandrel axis 314. The mandrel drive apparatus 330 thereby provides winding of the web 50 upon the core 302 supported on the mandrel 300 to form a log 51 of web material wound around the core 302. The mandrel drive apparatus 330 provides center winding of the paper web 50 upon the cores 302 (that is, by connecting the mandrel with a drive which rotates the mandrel 300 about its axis 314, so that the web is pulled onto the core), as opposed to surface winding wherein a portion of the outer surface on the log 51 is contacted by a rotating winding drum such that the web is pushed, by friction, onto the mandrel. The present invention can be applicable to both center winding and surface winding mandrels.

As the core 302 is carried along the web winding segment 324 of the closed mandrel path 320, a web 50 is directed to the core 302 by a rewinder assembly 60 disposed upstream of the turret winder 100. The rewinder assembly 60 is shown in FIG. 1, and includes feed rolls 52 for carrying the web 50 to a perforator roll 54, a web slitter bed roll 56, and a web transfer and chop-off assembly 500.

The perforator roll 54 provides lines of perforations extending along the width of the web 50 in the cross machine direction. Adjacent lines of perforations are spaced apart a predetermined distance along the length of the web 50 to provide individual sheets joined together at the perforations. The sheet length of the individual sheets is the distance between adjacent lines of perforations.

During web transfer and web chop-off, the web 50 is transferred to an empty core 302 on a turret winder mandrel 300 at about the same time the web 50 is severed from a log 51, having completed the core winding cycle. The log 51 is supported on an adjacent mandrel in sequence on the turret assembly. The severance of the web 50 occurs at a predetermined perforation separating the last sheet on the log 51 from the first sheet transferred to the empty core 302 by creating enough tension in the web section to break the web at the predetermined perforation.

The present invention web transfer and chop off assembly 500 can include a bedroll 510 juxtaposed to the web path 53, rotating about an axis 512 which is parallel to the turret assembly axis 202. Such bedroll 510 can provide a transfer pad 514 and a chop-off assembly 520 for providing web transfer concurrently with web chop-off.

Figure 4:
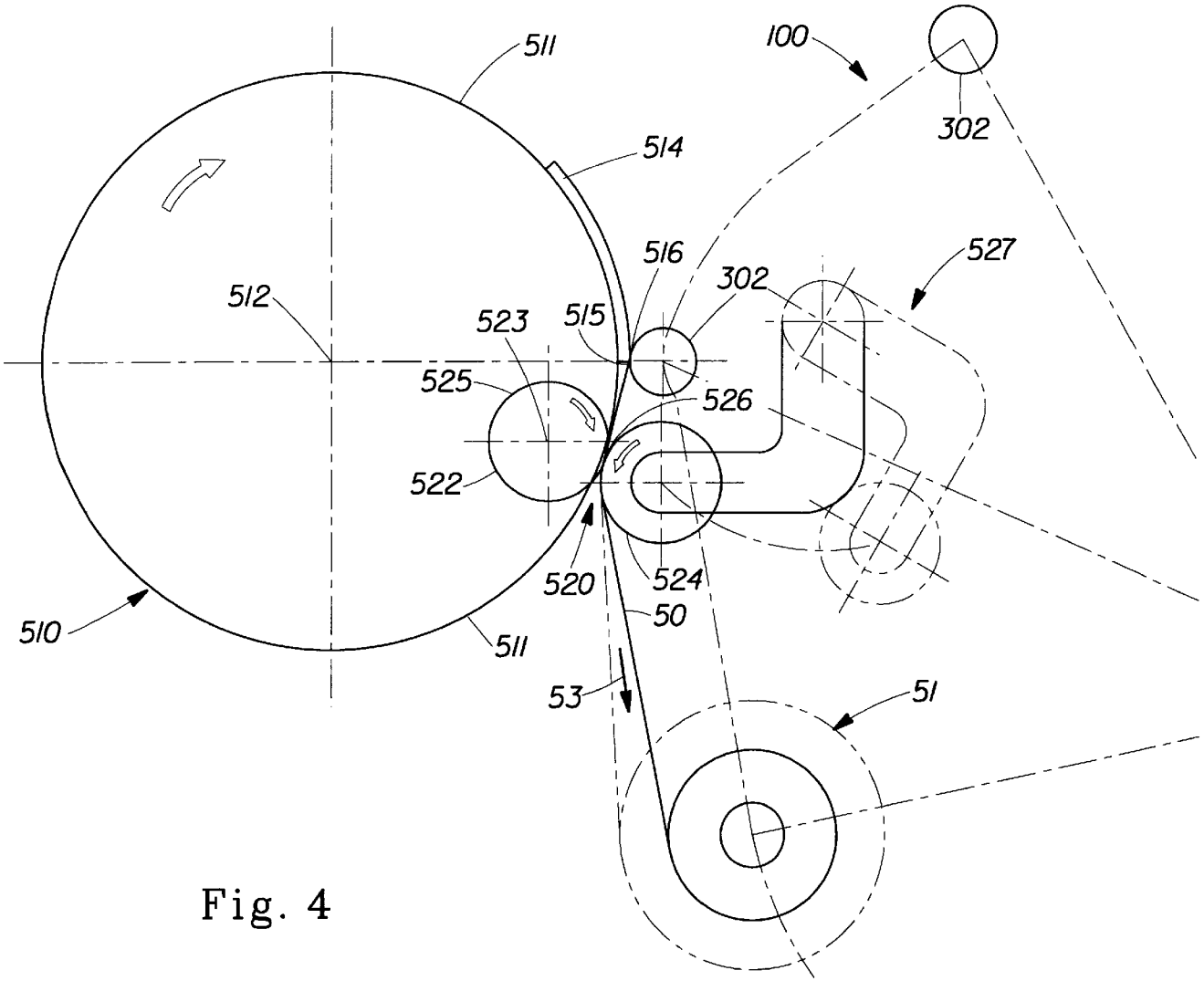
FIG. 4 is a side view of web transfer and chop-off assembly comprising a bedroll incorporating a transfer pad for web transfer and two chop-off rolls for web chop-off.

As shown in FIG. 4, the transfer pad 514 is mounted on the periphery 51 of the bedroll 510. The bedroll 510 completes an integer number of revolutions during the web rewinding cycle and is synchronized with the turret assembly 100 so that the transfer pad 514 forms a transfer nip 516 with the empty core 302 during web transfer.

The duration of the transfer nip 516 is controlled by the length of the pad covering the bedroll 510 which typically corresponds to the circumferential length of an empty core 302 so that during web transfer, the transfer nip 516 endures one revolution of the empty core 302. The rotation of the bedroll 510 is such that the surface speed of the outer surface of the transfer pad 514 is equal to the web speed.

The chop-off assembly 520 can comprise two counterrotating chop-off rolls, a first chop-off roll 522 rotatably mounted within the bedroll 510 and a second chop-off roll 524 positioned opposite the bedroll 510 and rotatably mounted to the turret assembly. Each chop-off roll 522, 524 can be approximately 3.0 inches in diameter and rotate at an angular velocity providing a surface speed that exceeds the web speed. Preferably, the chop-off rolls exceed the web speed by about 20% to about 40%. During web chop-off, the first and second chop-off rolls 522, 524 form a chop-off nip 526 which accelerates a section of the web 50 downstream of the transfer nip 516 creating sufficient tension to break the web 50 at a desired perforation.

The first chop-off roll 522 includes an axis 523 which runs parallel to and eccentric from the bedroll axis 512 such that the outer periphery 525 of the first chop-off roll 522 extends above the outer periphery 511 of the bedroll 510 approximately 0.125 inches allowing it to clear the core during the core winding cycle. The second chop-off roll 524 is rotatably mounted to a loading mechanism 527 that conveys the second chop-off roll 524 in to make contact with the first chop-off roll 522 during web chop-off and retracts the second chop-off roll 524 to allow the core to pass during the web winding cycle.

Prior to the empty core 302 reaching the transfer position, the second chop-off roll 524 starts to load towards the bedroll 510. The second chop-off roll 524 contacts the web 50 and deflects it toward the bedroll 510 as it continues to load. The empty core 302 reaches the transfer position and contacts the leading edge 515 of the transfer pad 514. A perforation is positioned between the transfer nip 516 and the chop-off nip 526. While the web 50 is secured between the empty core 302 and the transfer pad 514, the second chop-off roll 524 contacts the first chop-off roll 522 pinching the web 50 therebetween. The transfer pad 514 continues to press the web 50 against the core 302 for one core revolution as the over-speed of the chop-off rolls 522, 524 produces sufficient tension in the web 50 to separate the perforation.

Figure 5:
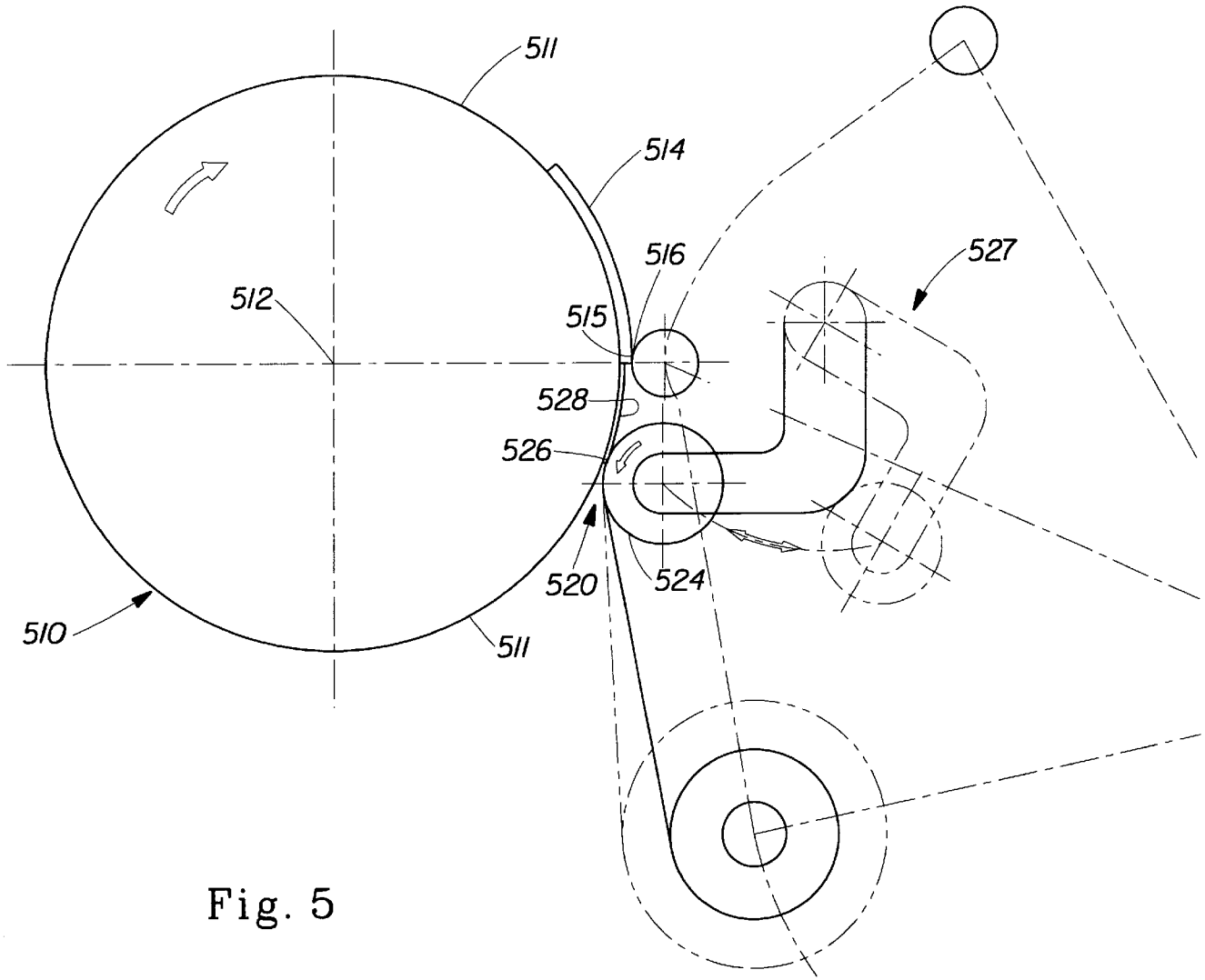
FIG. 5 is a side view of web transfer and chop-off assembly of FIG. 4 where the first chop-off roll mounted on the bedroll has been replaced with a nip pad on the periphery of the bedroll.

In an alternate embodiment shown in FIG. 5, the first chop-off roll 522 is replaced with a nip pad 528 located on the periphery 511 of the bedroll 510 adjacent to the leading edge 515 of the transfer pad 514. While the web 50 is pinched at the transfer nip 516, the second chop-off roll 524 contacts the web 50, deflects it towards the bedroll 510 and forms a chop-off nip 526 with the nip pad 528. The section of the web 50 between the transfer nip 516 and the chop-off nip 526 is accelerated, creating sufficient tension in the web 50 to separate the perforation.

Figure 6:
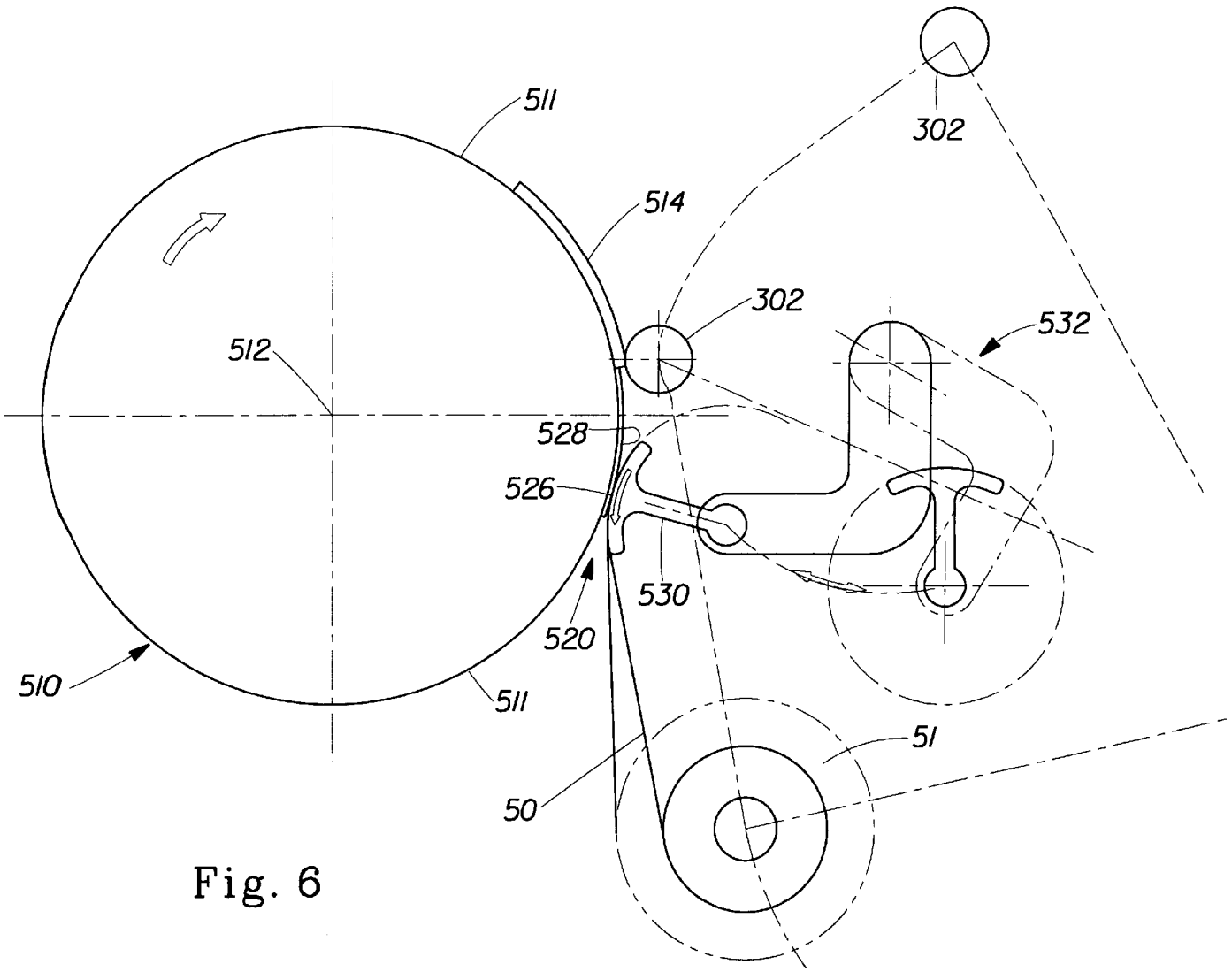
FIG. 6 is a side view of web transfer and chop-off assembly of FIG. 5 where the second chop-off roll has been replaced with a chopper arm

In another embodiment incorporating the nip pad 528 on the periphery 511 of the bedroll 510, the second chop-off roll 524 may be replaced with a driven chopper arm 530 as shown in FIG. 6. The chopper arm 530 rotates creating a surface speed that exceeds the speed of the web 50. The chopper arm 530 is mounted to a loading mechanism 532 which feeds the chopper arm in to make contact with the optional nip pad 528 forming the chop-off nip 526 during web chop-off and retracts the chopper arm to clear the core during the winding cycle.

Figure 7:
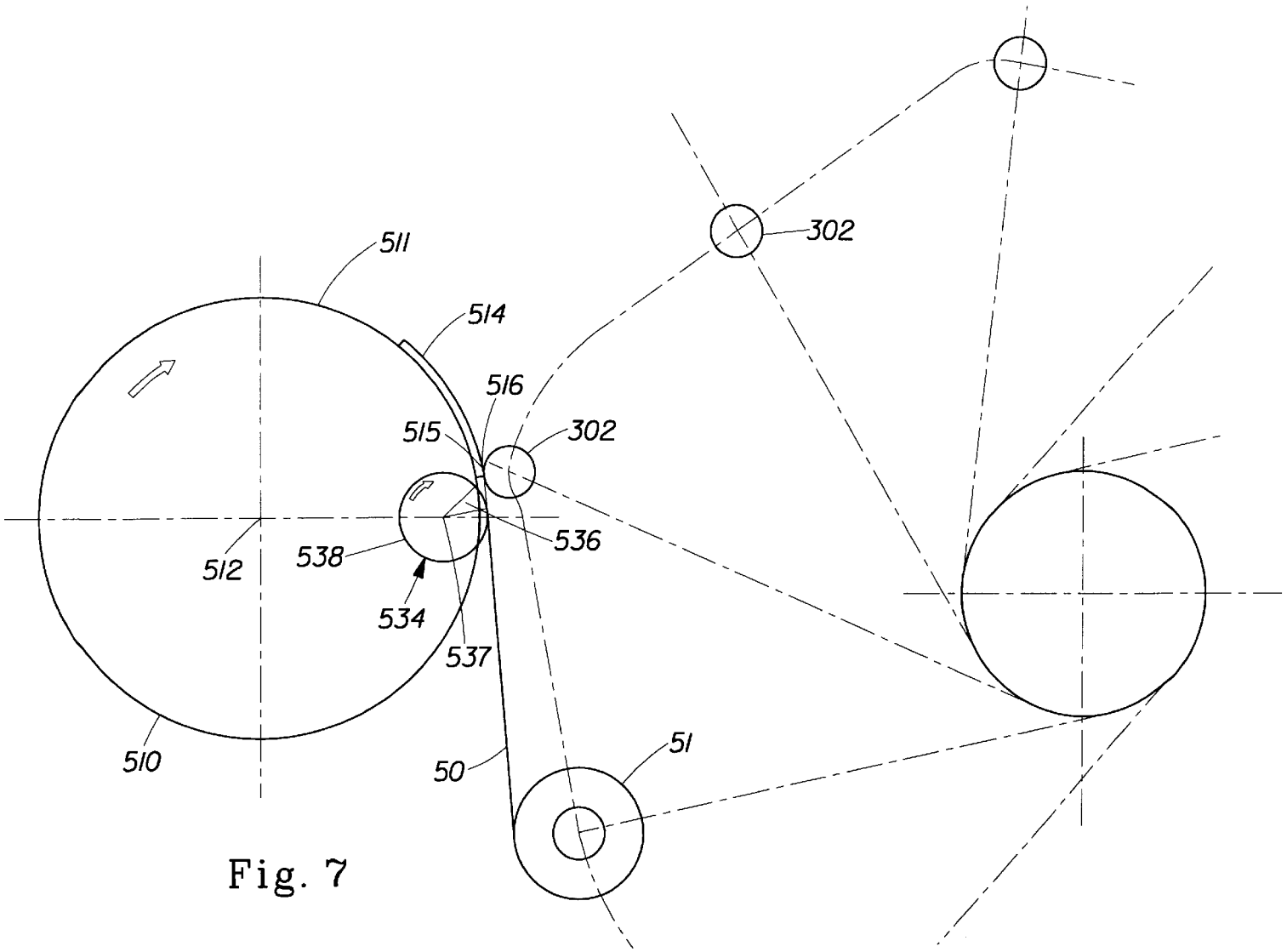
FIG. 7 is a side view of web transfer and chop-off assembly of FIG. 4 where the two chop-off rolls have been replaced with a vacuum roll rotatably mounted within the bedroll for web chop-off.

In another embodiment, the chop-off assembly 520 can comprise a vacuum roll 534 rotatably mounted within the bedroll 510 as shown in FIG. 7. The vacuum roll 534 includes a chamber 536 covering a limited portion of the vacuum roll periphery 538 providing suction to grab a hold of the web 50 during web chop-off Although the size of the vacuum roll 534 can vary, it is preferred that the vacuum roll 534 be about 3.0 inches in diameter. The vacuum roll 534 rotates at an angular velocity providing a surface speed that exceeds the web speed. The vacuum roll 534 includes an axis 537 which runs parallel to and eccentric from the bedroll axis 512 such that the outer periphery 538 of the vacuum roll 534 extends above the bedroll periphery 511 a limited amount, allowing it to clear the core during the winding cycle.

At the start of the transfer sequence, the leading edge 515 of the transfer pad 514 forms the transfer nip 516 with the empty core 302 and the vacuum chamber 536 engages the web 50. A perforation is positioned between the transfer nip 516 and the vacuum chamber 536. As the transfer pad 514 continues to press the web 50 against the empty core 302 for one full revolution of the core 302, the over-speed of the vacuum roll 534 creates sufficient tension to separate the web 50 at the perforation.

Figure 8:
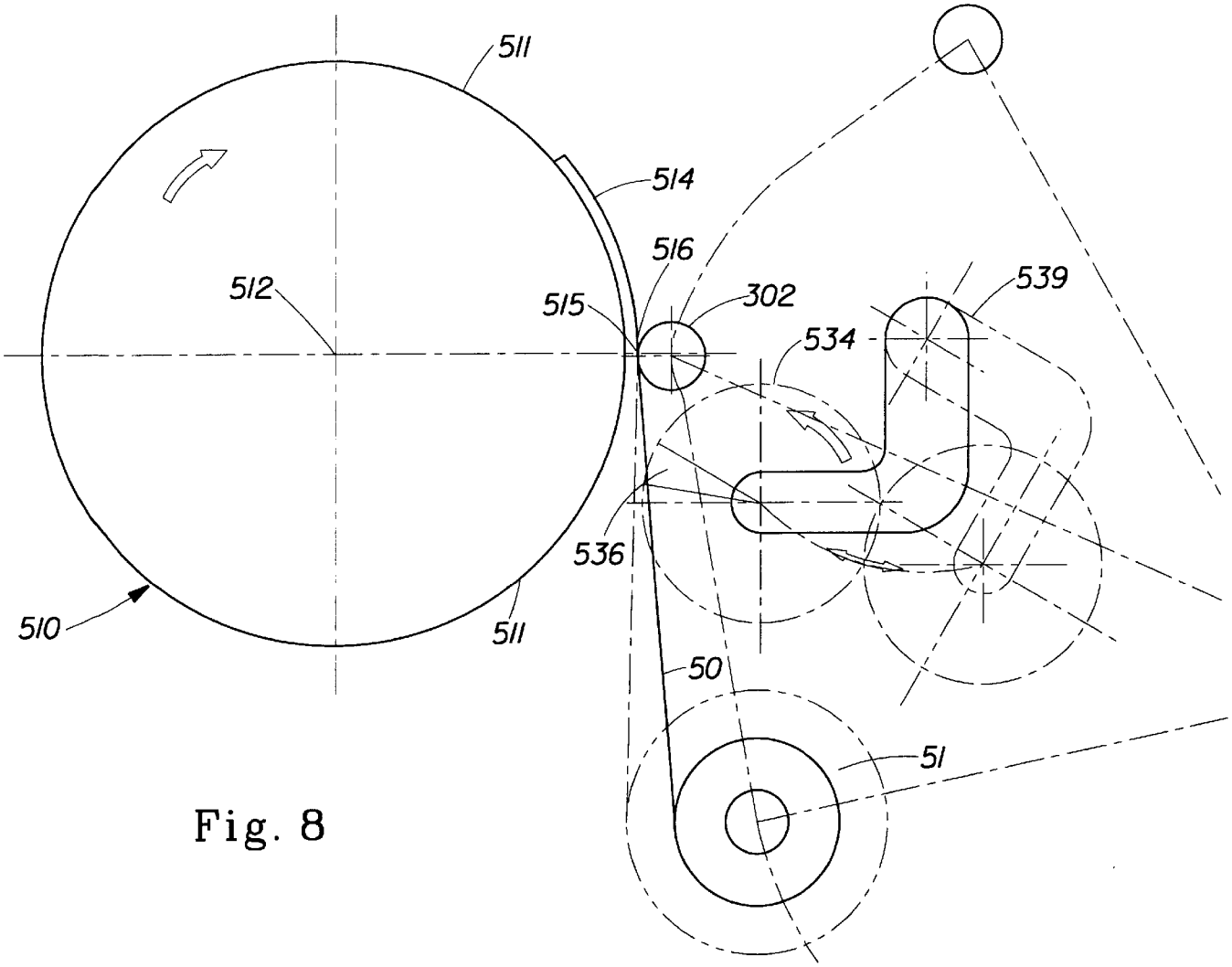
FIG. 8 is a side view of web transfer and chop-off assembly of FIG. 4 where the two chop-off rolls have been replaced with a vacuum roll rotatably mounted to a loading mechanism disposed opposite the bedroll.

Alternatively, the vacuum roll 534 can be rotatably mounted to a loading mechanism 539 positioned opposite the bedroll 510 and counterrotating with respect thereto as shown in FIG. 8. For this embodiment, the vacuum roll 534 starts to load in towards the bedroll 510 prior to the empty core 302 reaching the transfer position. As the empty core 302 forms the transfer nip 516 with the transfer pad 514, the vacuum roll 534 contacts the web 50. As the transfer pad 514 continues to press the web 50 against the empty core 302 for one full revolution of the core 302, the over-speed of the vacuum roll 534 creates sufficient tension to separate the web 50 at the perforation. Once the web 50 is severed, the vacuum roll 534 retracts allowing the core to pass and complete the winding cycle.

Paper products such as paper towels and toilet tissue are often treated with performance enhancing fluids. Performance enhancing fluids are typically added prior to the rewinding process resulting in a fluid contaminated perforator roll which affects perforation reliability and results in equipment downtime. Although the fluid application system 600 may be installed downstream of the perforator roll 54 prior to the bedroll 510, the size of the bedroll 510 often leaves little room for the installation of such a system. In addition, the bedroll 510 would become coated with the performance enhancing fluids and require frequent cleaning, resulting in significant equipment downtime.

Transferring the web 50 to an empty core can be completed, absent a bedroll, in a number of different ways such as dynamically utilizing air in the form of a jet or a vacuum or mechanically by way of a cam or a bell crank operation. Furthermore, the web transfer assembly can include a transfer roll 540. The transfer roll 540, which can be about 3.0 inches in diameter, counterrotates with respect to the core at an angular velocity providing a surface speed that equals the web speed. The transfer roll 540 can be rotatably attached to a loading mechanism positioned opposite the turret assembly. The loading mechanism moves the transfer roll 540 from a first position forming a transfer nip 516 with the empty core 302 to a second position withdrawn away from the web 50 allowing the core to pass during the core winding cycle. The loading mechanism can comprise a linear electric motor or a linear hydraulic cylinder.

Figure 9:
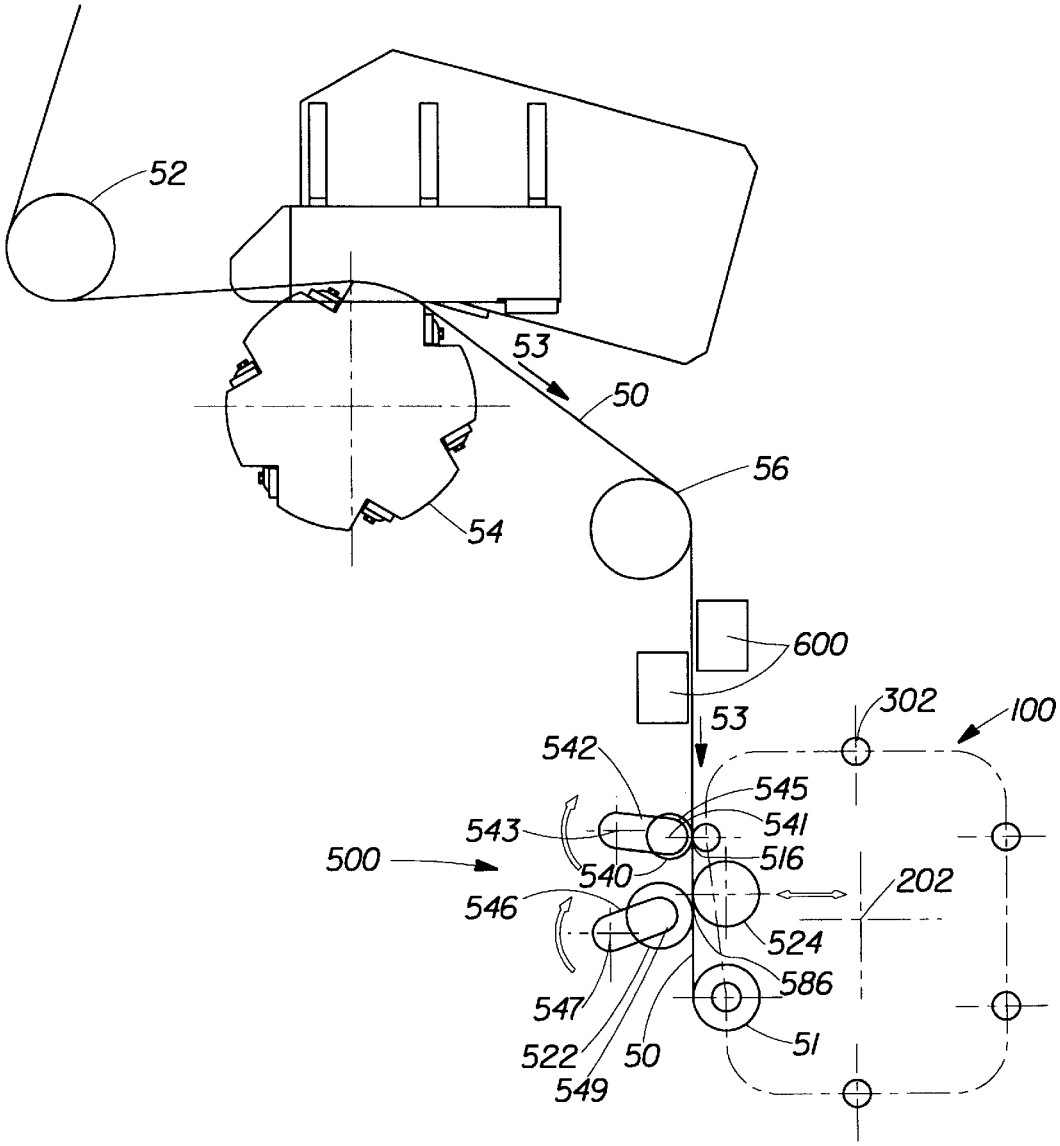
FIG. 9 is a side view of a web rewinder assembly incorporating a fluid application system within the rewinder assembly wherein the web transfer assembly comprises a transfer roll mounted to a transfer roll pivot arm and forming a transfer nip with an empty core and the chop-off assembly comprises a first chop-off roll rotatably mounted to a chop-off roll pivot arm forming a chop-off nip with a second chop-off roll.

In one embodiment shown in FIG. 9, the loading mechanism for the transfer roll 540 comprises a transfer roll pivot arm 542. The transfer roll pivot arm 542 includes a pivot end 543 and a second end 545. The transfer roll 540 is rotatably attached to the second end 545 of the pivot arm 542 which can be sized such that the distance between the pivot end 543 and the transfer roll axis 541 is about 3.5 inches.

During the rewinding process, the transfer roll 540 rotates about the pivot end 543 of the transfer roll pivot arm 542 from a first position forming the transfer nip 516 with the empty core 302 to a second position withdrawn away from the web 50. For this embodiment, the rotation of the transfer roll pivot arm 542 is synchronized with the turret assembly 100 and can be made to maintain the transfer nip 516 for one full revolution of the core as well as complete one revolution about the pivot end 543 in one core winding cycle.

The chop-off assembly can also be provided absent a bedroll 510. Two chop off rolls 522, 524 (each about 3.0 inches in diameter) can be disposed on opposite sides of the web 50 to form a chop-off nip 526 downstream of the transfer nip 516 during web transfer. The two chop-off rolls 522, 524 counterrotate at angular velocities such that the outer surface speed of the two chop-off rolls exceed the web speed.

Each chop-off roll 522, 524 can be rotatably attached to a separate loading mechanism. The loading mechanisms move the two chop-off rolls from first positions forming a chop-off nip 526 pinching the web 50 therebetween to a second position withdrawn away from the web 50. Like the transfer roll 540, the loading mechanisms for the two chop-off rolls 522, 524 can comprise linear electric motors or hydraulic linear actuators.

Prior to the empty core 302 reaching the transfer position, the two chop-off rolls 522, 524 advance towards the web 50 forming the chop-off nip 526. At the start of the transfer sequence, the web is secured at the transfer nip 516, and a perforation is positioned between the transfer nip 516 and the chop-off nip 526. The over-speed of the two chop-off rolls 522, 524 accelerates the web section between the two nips 516, 526 breaking the perforation.

In the embodiment illustrated in FIG. 9, the loading mechanism for the first chop-off roll 522 comprises a chop-off roll pivot arm 546 having a pivot end 547 and a second end 549. The first chop-off roll 522 is rotatably attached to the second end 549 of the chop-off roll pivot arm 546. The chop-off roll pivot arm 546 can be sized such that the distance between the pivot end 547 and the first chop-off roll axis 523 is about 3.5 inches.

During the rewinding process, the first chop-off roll 522 rotates about the pivot end 547 of the chop-off roll pivot arm 546 from a first position forming the chop-off nip 526 with the second chop-off roll 524 pinching the web therebetween to a second position withdrawn away from the web 50. The chop-off roll pivot arm 546 can be made to complete one revolution in one core winding cycle.

Figure 10:
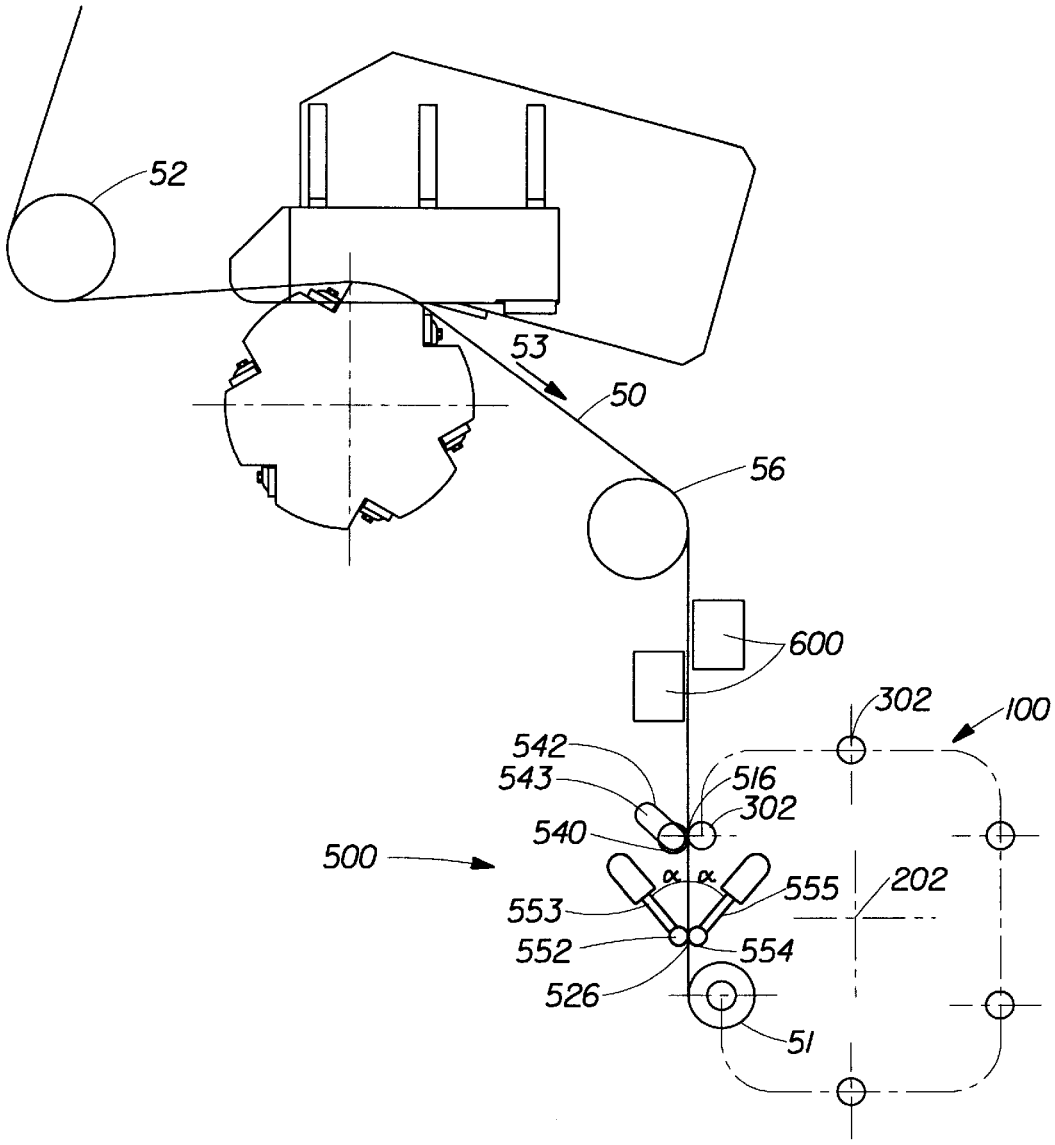
FIG. 10 is a side view of the web rewinder assembly shown in FIG. 9 wherein the web chop-off assembly comprises two chop-off pads mounted to pivoting linearly extendible rods.

In another embodiment illustrated in FIG. 10, the chop-off assembly 520 comprises a first chop-off pad 552 mounted to a first pivoting linearly extendible rod 553 and a second chop-off pad 554, disposed opposite the first chop-off pad 552, mounted to a second pivoting linearly extendible rod 555. The linearly extendible rods 553, 555 advance the pads 552, 554 towards the web 50 to a first position forming a chop-off nip 526 pinching the web therebetween during web chop-off, and retract the pads 552, 554 away from the web 50 during the core winding cycle.

Prior to the empty core 302 reaching the transfer position the pivoting linearly extendible rods 553, 555 advance the chop-off pads toward the web path 53 converging the pads 552, 554 at the chop-off nip 526. As the web 50 is secured at the transfer nip 516, a perforation is positioned between the transfer nip 516 and the chop-off nip 526. In order to break the perforation, the pivoting linearly extendible rods 553, 555 continue to elongate in unison to their full extensions while pinching the web 50 at the chop-off nip.

Figure 11:
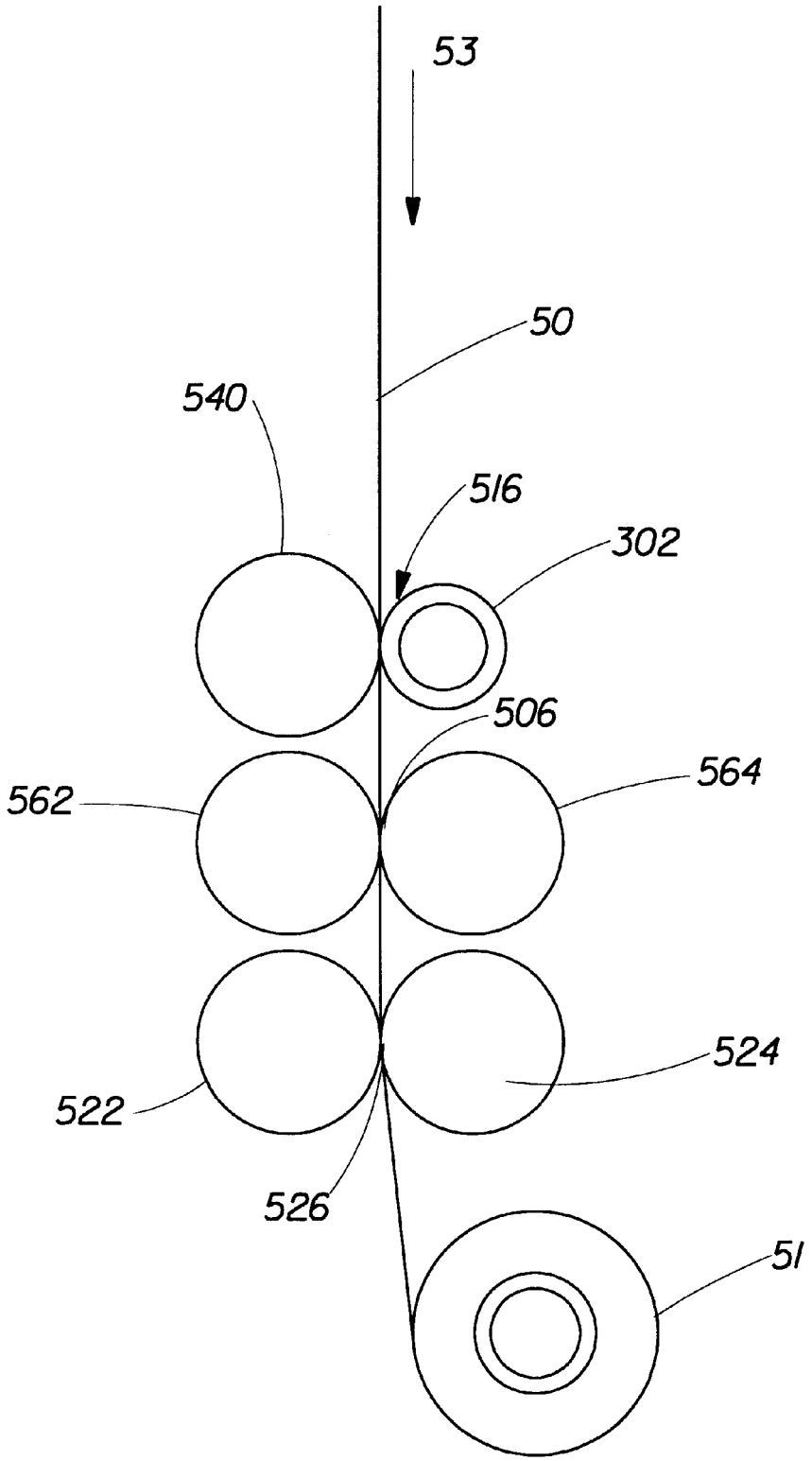
FIG. 11 is a side view of the web transfer and chop-off assembly shown in FIG. 9 wherein the chop-off assembly includes two intermediate rolls forming an intermediate nip between the transfer nip and the chop-off nip.

In another embodiment shown in FIG. 11, the chop-off assembly can include a first intermediate roll 562 and a second intermediate roll 564 disposed on opposite sides of the web path 53 between the transfer nip 516 and the chop-off nip 526. Each intermediate roll is rotatably mounted to a loading mechanism for moving the intermediate rolls from first positions, forming an intermediate nip 506 and pinching the web 50 therebetween, to second positions retracted away from the web path 53.

For this embodiment, the two intermediate rolls 562, 564 counterrotate at surface speeds that differ from the surface speeds of the two chop-off rolls 522, 524. Once the intermediate nip 506 and the chop-off nip 526 are formed, the speed differential produces sufficient tension to break the web 50 at the desired perforation. Thus, the two chop-off rolls 522, 524 can be made to counterrotate at surface speeds that equal the web speed while the intermediate rolls 562, 564 counterrotate at surface speeds less than the web speed. Conversely, the two intermediate rolls 562, 564 can be made to counterrotate at surface speeds that equal the web speed while the two chop-off rolls 522, 524 rotate at surface speeds exceeding the web speed.

In either case, at the start of the transfer sequence, the web is secured at the transfer nip 516, and a perforation is positioned between the intermediate nip 506 and the chop-off nip 526 locations. The intermediate rolls 562, 564 and the chop-off rolls 522, 524 advance towards the web forming the respective nips 506 and 526. As the transfer roll 540 continues to maintain the transfer nip 516 for one full revolution of the empty core 302, the difference in surface speed between the two nips 506 and 526 produces a tension in the web section interposed therebetween sufficient to separate the web 50 at the perforation.

In another embodiment, the two intermediate rolls 562, 564 can be made to counterrotate producing surface speeds in the direction opposite the web path 53. For this embodiment, the two chop-off rolls 562, 564 can counterrotate at surface speeds that equal the web speed. As the web is secured at the transfer nip 516, a perforation is positioned between the intermediate nip 506 and the chop-off nip 526 locations. The intermediate rolls 562, 564 and the chop-off rolls 522, 524 advance towards the web path forming the respective intermediate nip 506 and the chop-off nip 526. The opposing surface speeds at the two nips 506, 526 pull the web in counter directions creating sufficient tension to break the web 50 at the perforation.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

adhesive application apparatus (not Shown)
transfer roll loading mechanism (not shown)
paper web 50
log 51
feed rolls 52
web path 53
perforator roll 54
web slitter roll 56
Web rewinding assembly 60
rotating turret winder assembly 100
rotatably driven turret assembly 200
turret assembly central axis 202
mandrels 300
cores 302
first mandrel end 310
second mandrel end 312
mandrel axis 314
closed mandrel path 320
core loading segment 322
a web winding segment 324
core stripping segment 326
mandrel drive apparatus 330
mandrel cupping assembly 400
web transfer and chop-off assembly 500
Intermediate nip 506
bedroll 510
periphery of bedroll 511
bedroll axis 512
transfer pad 514
leading edge of transfer pad 515
transfer nip 516 516 chop-off assembly 520
first chop-off roll 522
first chop-off roll axis 523
second chop-off roll 524
outer periphery of first chop-off roll 525
chop-off nip 526
second chop-off roll loading mechanism 527
nip pad on periphery of bedroll 528
chopper arm 530
chopper arm loading mechanism 532
vacuum roll 534
vacuum chamber 536
vacuum roll axis 537
vacuum roll periphery 538
vacuum roll loading mechanism 539
transfer roll 540
transfer roll axis 541
transfer roll pivot arm 542
pivot end of transfer roll pivot arm 543
second end of transfer roll pivot arm 545
chop-off roll pivot arm 546
pivot end of chop-off roll pivot arm 547
second end of chop-off roll pivot arm 549
first chop-off pad 552
1ST pivoting linearly extendible rod 553
second chop-off pad 554
2nd pivoting linearly extendible rod 555
First intermediate roll 562
Second intermediate roll 564

What is claimed is:

1. A web transfer and chop-off assembly for attaching a web advancing along a path at a web speed to an empty core supported on a first mandrel of a web winding turret assembly, orbiting about an axis, at about the same time the web is severed from a log supported on a second mandrel of the turret assembly after the log has completed a web to core winding cycle, the web transfer and chop-off assembly comprising:

a bedroll positioned opposite to the turret assembly with the web interposed therebetween, the bedroll rotating about an axis parallel to the turret assembly axis;

a transfer pad mounted on an outer surface of the bedroll and covering a portion thereof, wherein during rotation of the bedroll the transfer pad forms a transfer nip with the empty core pressing the web therebetween; and a chop-off assembly disposed intermediate the transfer nip and the log, wherein the chop-off assembly comprises a first chop-off roll rotatable mounted within the bedroll adjacent to the transfer pad and having an axis running parallel to and eccentric from the bedroll axis, and a second chop-off roll positioned opposite to the bedroll with the web interposed therebetween, wherein during rotation of the bedroll the first chop-off roll is juxtaposed with the web path, and the second chop-off roll advances towards the bedroll to form a chop-off nip with the first chop-off roll during the web chop-off and retracting away from the bedroll during the web to core winding cycle.

2. The web transfer and chop-off assembly of claim 1, wherein the transfer pad covers a circumferential span of the bedroll which is about equal to the circumferential length of the empty core.

3. The web transfer and chop-off assembly of claim 1, wherein the first and second chop-off rolls have surface speeds that exceed the web speed by about 20% to about 40%.

4. The web transfer and chop-off assembly of claim 1, wherein the web chop-off assembly comprises a vacuum roll rotatably mounted downstream of the transfer nip, the vacuum roll having a vacuum chamber for gripping the web, wherein the vacuum roll grips the web at about the same time the transfer pad forms a nip with the empty core.

5. The web transfer and chop-off assembly of claim 4, wherein the vacuum roll is rotatably mounted within the bedroll adjacent to the transfer pad, the vacuum roll having an axis running parallel to and eccentric from the bedroll axis, wherein during rotation of the bedroll the vacuum roll is juxtaposed to the web path.

6. The web transfer and chop-off assembly of claim 4, wherein the vacuum roll is movable to advance towards the web path to grab the web during the web chop-off and to withdraw away from the web during the web to core winding cycle.

7. A web transfer and chop-off assembly for attaching a web advancing along a web path and at a web speed to an empty core supported on a first mandrel of a web winding turret assembly, orbiting about an axis, at about the same time the web is severed from a log supported on a second mandrel of the turret assembly after the log has completed a web to core winding cycle, the web transfer and chop-off assembly comprising:

a bedroll positioned opposite to the turret assembly with the web interposed therebetween, the bedroll rotating about an axis parallel to the turret assembly axis;

a transfer pad mounted on an outer surface of the bedroll and covering a portion thereof, wherein during rotation of the bedroll the transfer pad forms a transfer nip with the empty core pressing the web therebetween; and a chop-off assembly disposed intermediate the transfer nip and the log, wherein the web chop-off assembly comprises a nip pad mounted on the outer surface of the bedroll adjacent to the transfer pad such that during rotation of the bedroll the nip pad is juxtaposed with the web path; and a chop-off roll positioned opposite to the bedroll with the web interposed therebetween, wherein the chop-off roll advances towards the bedroll thereby forming a chop-off nip with the nip pad during the web chop-off and withdraws away from the bedroll during the web to core winding cycle.

8. The web transfer and chop-off assembly of claim 7, wherein the chop-off roll has a surface speed that exceeds the web speed by about 20% to about 40%.

* * * * *

UNITED STATES PATENT AND TRADEMARK OFFICE

CERTIFICATE OF CORRECTION

PATENT NO. : 6,308,909 B1
DATED : October 30, 2001
INVENTOR(S) : Kevin Benson McNeil et al.

It is certified that error appears in the above-identified patent and that said Letters Patent is hereby corrected as shown below:

Column 5,
Line 39, "3 0" should read -- 310 --.

Column 6,
Line 43, "51" should read -- 511 --.

Signed and Sealed this

Third Day of September, 2002

*Attest:*

*Attesting Officer*

JAMES E. ROGAN
*Director of the United States Patent and Trademark Office*